United States Patent [19]

Magnien et al.

[11] Patent Number: 4,761,865

[45] Date of Patent: Aug. 9, 1988

[54] PROCESS FOR THE MECHANIZED PRODUCTION OF JEWELRY COMPRISING A PLURALITY OF SMALL CONTIGUOUS STONES SET IN A METAL SUPPORT

[75] Inventors: Emile G. Magnien; Alain M. Plantureux, both of Montpellier, France

[73] Assignee: Diamants Applications, Montrellier, France

[21] Appl. No.: 3,190

[22] Filed: Jan. 14, 1987

[30] Foreign Application Priority Data

Jan. 17, 1986 [FR] France ..... 86 00735

[51] Int. Cl.[4] ..... B23P 5/00

[52] U.S. Cl. ..... 29/10; 29/160.6; 63/28

[58] Field of Search ..... 29/10, 160.6; 63/26, 63/28

[56] References Cited

U.S. PATENT DOCUMENTS 1,308,011 6/1919 Gilsey ..... 63/26
1,351,205 8/1920 Eliasoff ..... 63/28
1,529,831 3/1925 Brennan ..... 29/10
2,858,597 11/1958 Kraemer ..... 29/10

FOREIGN PATENT DOCUMENTS 124436 11/1984 European Pat. Off. ..... 29/10
1506317 12/1967 France .
2386281 11/1978 France .

*Primary Examiner*—P. W. Echols
*Attorney, Agent, or Firm*—Balogh, Osann, Kramer, Dvorak, Genova & Traub

[57] ABSTRACT

Process for the mechanized production of jewelry comprising a plurality of small contiguous precious stones set in a metal support consisting in machining in said support, bores that are aligned, and in machining on the periphery of said bores, truncated studs of which the walls converge upwardly and the diameter of the circle inscribed inside the top parts of the studs is greater than the diameter of the largest stones, whereas the diameter of the circle inscribed inside the bases of the studs is smaller than the diameter of the largest stones.

5 Claims, 7 Drawing Sheets

PROCESS FOR THE MECHANIZED PRODUCTION OF JEWELRY COMPRISING A PLURALITY OF SMALL CONTIGUOUS STONES SET IN A METAL SUPPORT

The present invention relates to processes for the mechanized production of jewelry of the type composed of a plurality of small contiguous stones, set in a metal support. The invention also relates to the jewelry produced according to said processes.

The technical sector of the invention is that of the production of jewelry.

The numerical control machine-tools, and in particular the five-axes machine-tools which give five degrees of freedom of movement to the tool, have now made it possible to cut, in supports made of precious metal, very close together housings or cavities for receiving small contiguous stones, with a very high machining precision of the order of 0.01 mm. Said machine-tools have also permitted the removal of some of the metal from the periphery of each housing or cavity, leaving only a small number of claws which are deformed for setting the stones.

The small precious stones, generally diamonds, which are used in the manufacture of such jewellery, are hand-cut. Said stones are graded with precision, conventionally, by using a series of screens of which the meshes vary by 0.05 mm and even 0.02 mm from one screen to the other.

On the other hand, stones of the same size grading generally have different heights of upper face, namely different heights of the external and visible face of a stone with respect to the face by which said stone rests on its seating.

Such height differences can reach 0.1 mm for stones having a diameter of one millimeter.

Because the seatings designed to receive the stones are machined in series and are all on the same level, the upper faces of the different stones in a paving are all at different levels, which makes the jewelry rather inaesthetic.

Moreover, when using the technique of mechanical setting by deformation of the claws with a tool mounted on a machine, the movement of the setting tool is necessarily the same for all the claws and the highest stones can become compressed and risk to be crushed.

Processes which mechanize the production of jewelry of the type comprising small contiguous stones set in a metal support, are already known wherein a plurality of contiguous equidistant housings are cut with fine precision in said support, each of said housing comprising a seating on which a stone is set to rest, and setting claws situated on the housing periphery.

Other processes of this type are also known, in which the housings are cut in such a way as to have in each one a very narrow annular seating which can be deformed. A push member is then pressed against the external faces of the stones laid on their seating. Said push member rests against the upper faces of the highest stones and the pressure that it applies thereon deforms the narrow seating, so that at the end of the operation, the upper faces of all the stones are all contained in the same plane, in the case of a flat support, or on the same curved surface, parallel to the external face of the support, when said support is curved.

According to the aforesaid known process, complex machining operations are necessary before a narrow and deformable annular seating can be obtained with precision on the periphery of housings which have a diameter of about one millimeter.

It is an object of the present invention to improve the supports machining process so as to eliminate the need of producing a narrow annular seating in machining claws so that the stones are borne directly by the claws, in such a way that the claws bearing points are deformable and so that when a push member is applied against the upper faces of the stones, the highest among the stones push aside the metal of the bearing points and sink in more deeply than the shorter stones, and that pieces of jewelry are finally obtained of which the visible faces of all the stones are contained in the same plane or on the same curved surface, despite the height differences between the stones.

One process according to the invention for mechanizing the production of jewelry comprising a plurality of small contiguous stones of uniform size grading but different heights, which are set in a metal support, is of a known type and consists in machining contiguous and equidistant bores in said supports, each bore comprising a deformable seating over which rests a stone, setting claws being cut in the periphery of each housing and being common to several stones.

The object of the invention is reached with a process according to which a plurality of truncated studs are machined on the periphery of each bore, said studs being situated at the apices of a polygon surrounding said bore and having their side walls converging towards the external face of said support, and said studs being machined with a conical tool which removes discs of metal which overlap. A stone is placed in each bore, said stone resting against the side faces of said studs. A push member is applied over the upper faces of the highest stones, said push member being parallel to the external face of the support, and pressure is applied to said push member, this causing the stones to sink in and in doing so to push back the metal of said studs until said push member is in contact with the upper faces of all the stones which, then, are in the same plane or on the same surface parallel to the external face of said support; thereafter, the stones are set by deforming the studs with a setting tool.

Generally, the stones that are used belong to the same size grading class which is defined by the diameters of the two superposed screens used for grading them.

Advantageously, the diameter of the circle inscribed inside the bases of the studs around one bore is equal to the diameter of the meshes of the screen on which the stones are held, and the diameter of the circle inscribed inside the tops of said studs is equal to the diameter of the meshes of the screen immediately above.

According to a variant embodiment, the process consists in machining in the support a plurality of bores which are each extended by a reverse blind bore, and each bore has a diameter greater than that of the circle inscribed inside the bases of the studs around it, so that each stud comprises cylindrical notches which are cut in its side walls by said bores.

The result of the invention is a new type of jewelry with pavings of small contiguous precious stones, which is produced mechanically on numerical control machine-tools, thus reducing production costs while permitting the high precision machining of the housings and of the setting claws, and making it possible to obtain pavings of very small stones such as, for example, pavings containing up to 80 stones per square centimeter.

In the processes according to the invention, the stones can be made to rest against the walls of four or six conical claws. As a result, the bearing surface of a stone can be very small at the beginning, and if pressure is applied to said stone, this in turn exerts on the metal of the bearing points, enough pressure to deform that metal permanently by pushing it back, so that the stone can sink inside its housing. Owing to this permanent deformation of the metal, it is possible to correct the differences of height between the upper faces of different stones of similar size grading, so that the upper faces of all the stones in one piece of jewelry, are situated on the same surface parallel to the external face of the support. The aesthetic effect then obtained is improved. It is moreover possible to mechanically set the stones by using a plate chuck which presses against the claws heads in order to buckle them up since, because the upper faces of all the stones are in the same plane, there will be no risk of crushing any of the highest stones during the mechanical setting operation, hence a reduction in setting costs.

This result is reached according to the invention without it being necessary to perform complex machining operations since the only machining operations that are required are those for cutting the bores and the truncated studs with a rotary tool such as a cutter, a chisel or a drill, capable of cutting discs or rings of metal while leaving a truncated central stud.

The invention will be more readily understood on reading the following description with reference to the accompanying drawings, in which:

FIG. 5 is a vertical section showing two stones having the same diameter but a different height, just placed in their housing and not set in.

Figure 7:
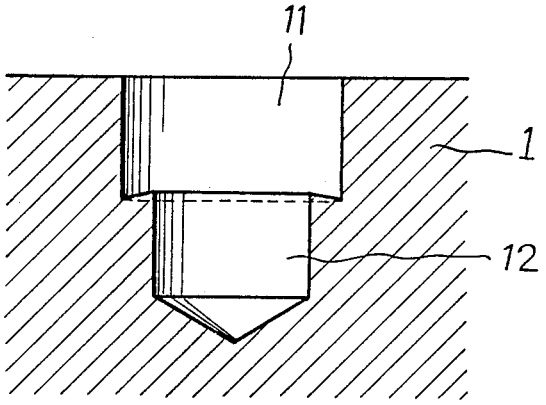
Figure 6:
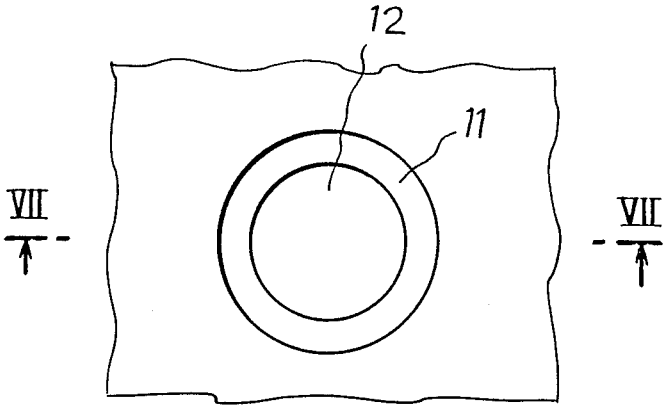

FIGS. 6 and 7 respectively show a plan view and a cross-section of a first machining step according to a variant embodiment of the invention.

Figure 9:
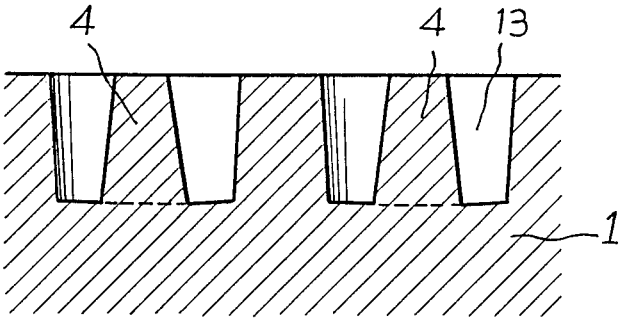
Figure 8:
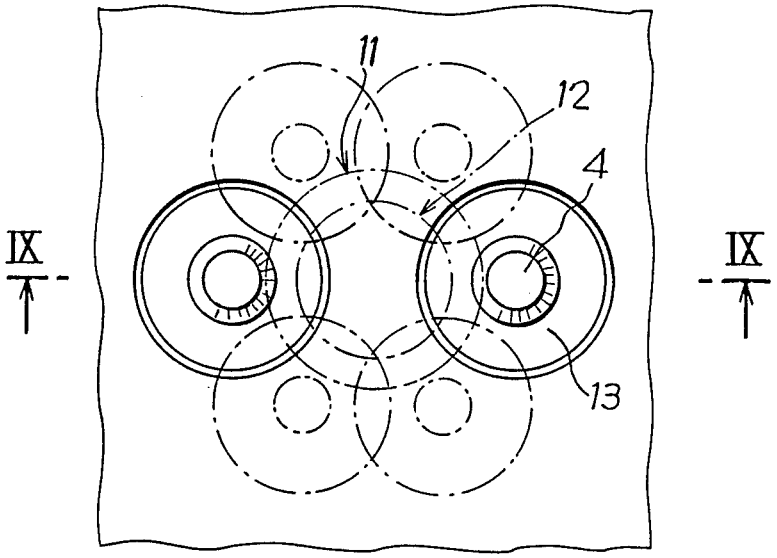

FIGS. 8 and 9 respectively show a plan view and a vertical section of the support after the two machining steps illustrated in FIGS. 6 to 9.

Figure 11:
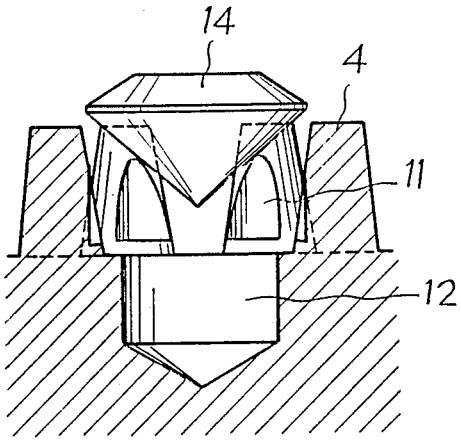
Figure 10:
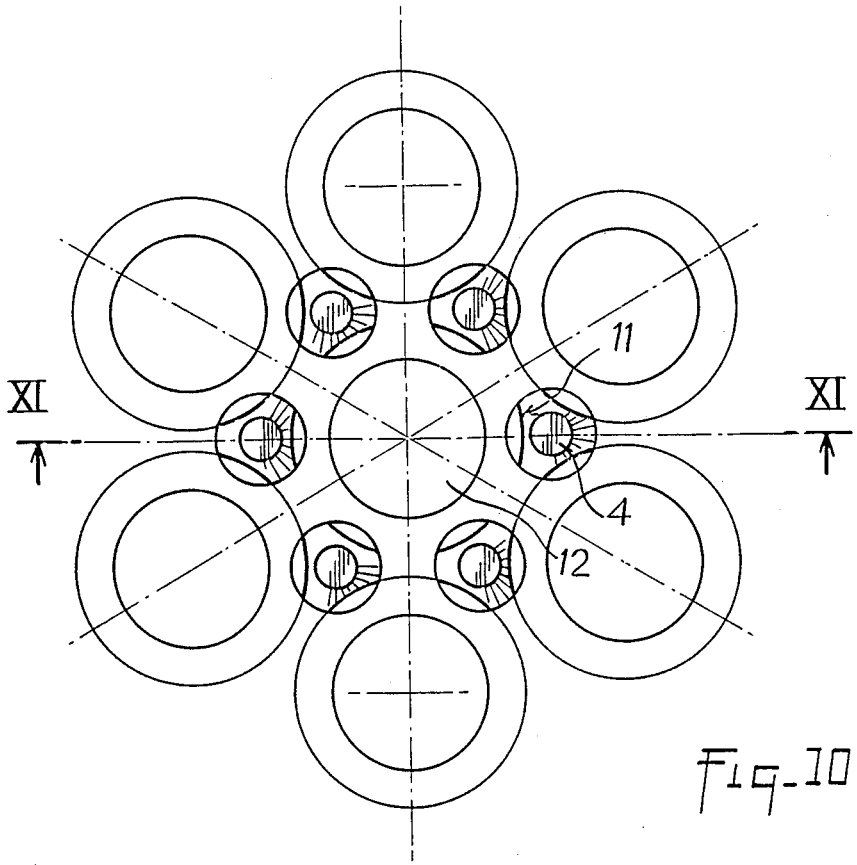

FIGS. 10 and 11 show, respectively, a plan view and a cross-section of a bore surrounded by six studs after the machining operations according to FIGS. 6 to 9.

Figure 12:
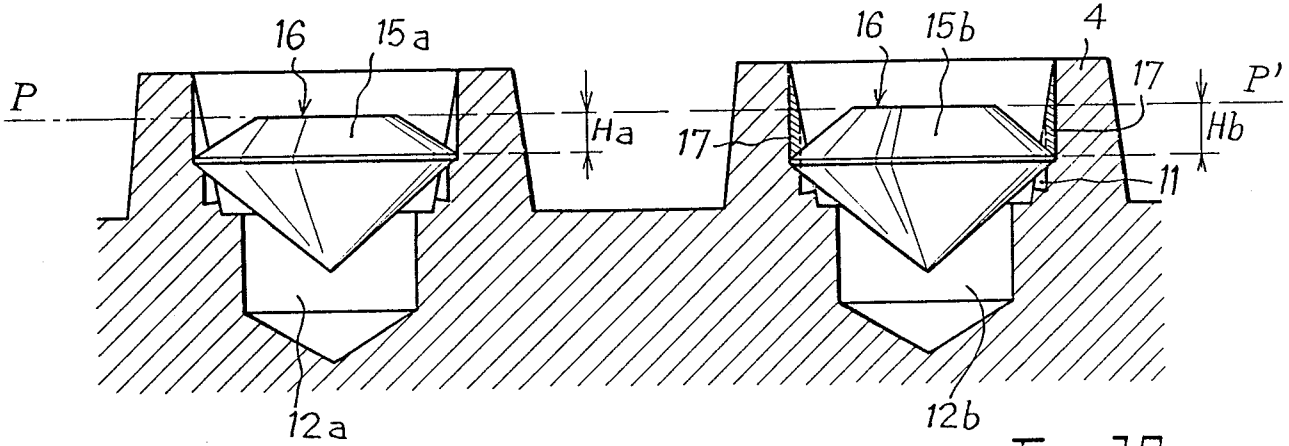

FIG. 12 is a vertical section showing two stones of different height engaged in two bores.

Figure 13:
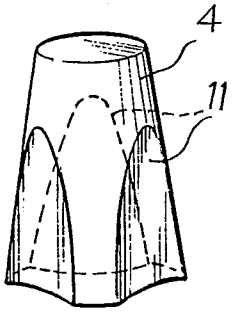

FIG. 13 is a perspective view of a stud according to the variant illustrated in FIGS. 6 to 12.

Figure 2:
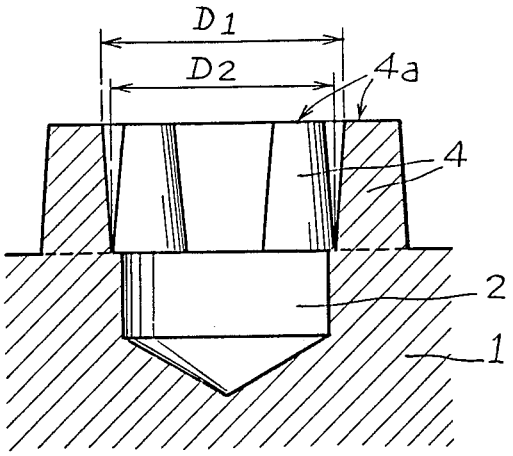
FIG. 2 is a cross-section along II—II of FIG. 1.
Figure 1:
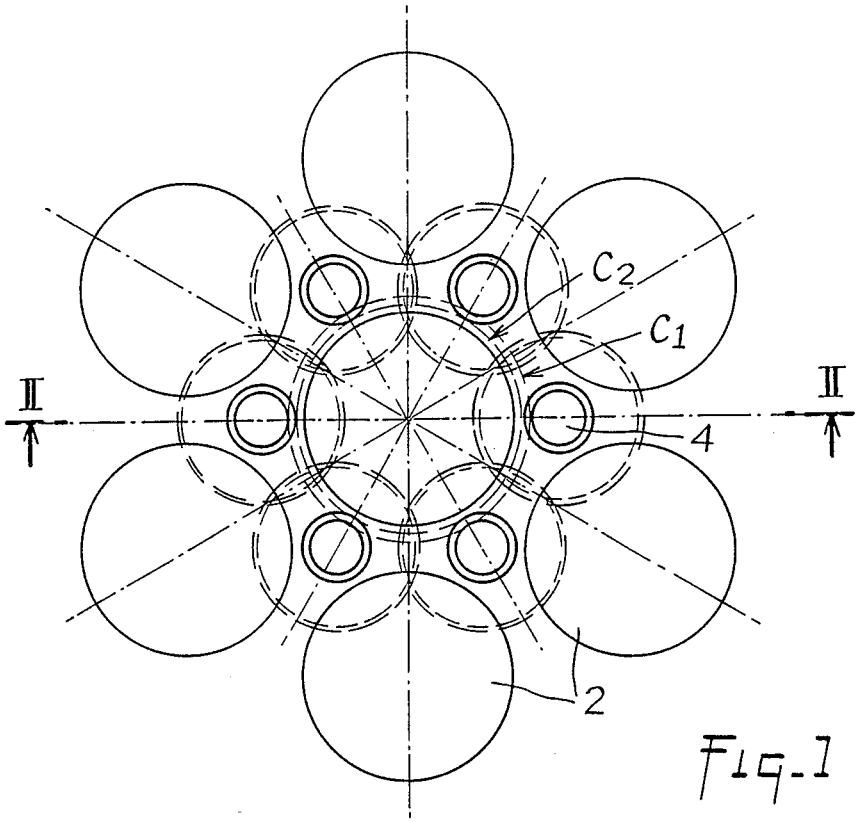
FIG. 1 is a plan view of one step in the machining of a metallic support designed to receive a paving of contiguous stones in staggered arrangement.

Referring now to the figures, FIGS. 1 and 2 respectively show a partial plan view and a vertical section of a support of jewelry 1 machined so as to receive small contiguous diamonds.

The support 1 is, for example, a flat plate in gold, destined to constitute part of a bracelet, or of a brooch, or of an earring. It can also be a support with one external curved face, such as for example a watch-case. The support 1 is destined to be trimmed with small contiguous precious stones, such as hand-cut diamonds, graded beforehand by being passed through a series of screens of which the meshes increase 0.05 mm from one screen to the other. All the stones that are used belong to the same size grading class, for example stones whose diameter varies between 1.10 mm and 1.15 mm, namely stones which are stopped by the screen with meshes of 1.10 mm after passing through the screen with meshes of 1.15 mm.

The support 1 is machined on a numerical control machine programmed for cutting in the support bores 2 of smaller diameter than the stones, for example equidistant bores having a diameter of 1 mm for stones varying between 1.1 and 1.15 mm.

Figure 3:
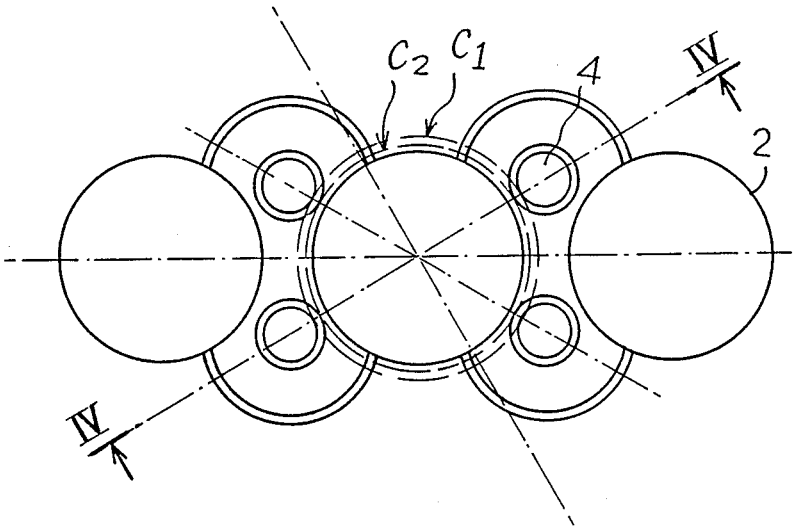
FIG. 3 is a plan view of one step in the machining of a metallic support designed to receive one row of contiguous stones.

FIG. 1 shows a preferential embodiment of the invention in which the bores are in staggered disposition, this permitting the insertion of a greater number of stones per surface unit. The bores 1 may also be disposed in alignment as illustrated in FIG. 3, or according to a checquered pattern.

The distance between the centers of two contiguous bores 2 is more than twice the radius of the bores so that said bores do not cut one into the other.

The numerical control machine enables the user to obtain a very high precision, of the order of 0.01 mm in the cutting and diameter of the bores 2.

Figure 4:
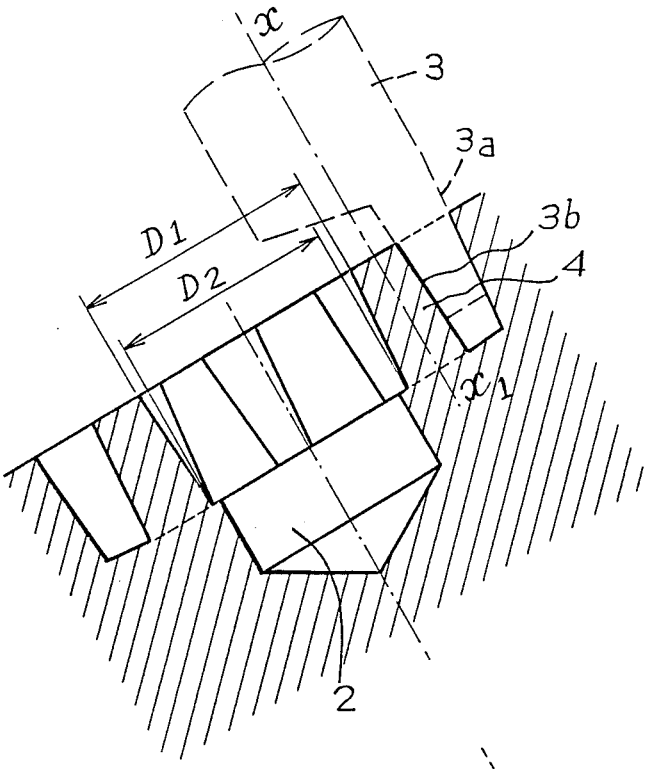
FIG. 4 is a cross-section along IV—IV of FIG. 3.

Another machining step is carried out on the numerical control machine on which is mounted a rotary tool 3 shaped as a cone bit or cutter such as illustrated in FIG. 4, for removing a disk or a ring of metal.

Said cone bit 3 comprises two cutting edges 3*a* and 3*b* which are slightly inclined with respect to the axis x x1 of the cone bit. The inner edge 3diverges with respect to axis x x1 towards the end of the cone bit, so that after the removal of the ring of metal, a small truncated stud of metal 4 is left in the center, the top part 4*a* of which is situated on the external face of the support 1.

The external edge 3*a* of the cone bit converges towards axis x x1 towards the end of the cone bit. The angle formed by edges 3*a* and 3*b* with axis x x1 is for example of 3°.

The radius of the external cutting edge is such that the cut rings of metal overlap and that only the studs 4 are left between the bores 2.

Said studs 4 act as setting claws for the stones, and at the same time, as will be seen hereinafter, as deformable seating on which the stones rest.

FIG. 1 illustrates a preferred embodiment of the invention in which the stones are set in staggered disposition, and each stone is held by six equidistant claws 4, the centers of which are situated at the apices of a hexagon which surrounds a bore 4.

Each claw 4 is common to three stones and the center of each claw 4, through which passes the axis x x1 of the cone bit during the stud machining step, is the center of the triangle formed by the vertical axes of three bores around one stud.

The centers of all the studs situated on the periphery of one bore are at the same distance from the center of said bore.

The height of the studs 4 is about half the height of the bore 2. The dimensions and conicity of the cutting edges of the cone bit are such that the circle C1 which is inscribed inside the top parts of the studs 4, has a diameter D1 which is slightly more than the diameter of the stones, and that the circle C2 inscribed inside the bases of the studs 4, has a diameter D2 which is slightly less than that of the stones. Advantageously, diameter D2 is equal to the diameter of the meshes of the screen on which the stones are stopped, and diameter D1 is equal to the diameter of the meshes of the screen immediately above. For example, in the case of stones of size grading between 1.10 mm and 1.15 mm, the diameters D2 and D1 are respectively equal to 1.10 mm±0.02, and to 1.15 mm±0.02.

The steps of machining the bores 2 and the studs 4 can take place in any order since the numerical control machine permits the positioning with very high precision of the tool for drilling the bores 2 and of the cone bit 3, independently one from the other.

FIGS. 3 and 4 show, respectively, a partial plan view and a cross-section of a second embodiment of a piece of jewelry as produced according to the invention, which comprises only one row of stones. In this case, each stone is held by four claws situated at the apices of a rectangle and each claw is common to two contiguous stones. The machining steps include the machining of a row of bores 2, whose diameters are less than the diameter of the selected stones and whose centers are equidistant and are placed at a distance greater than the diameter, so that the bores do not cut one into the other.

The machining steps also include the machining of the truncated studs 4 by the removal of rings of metal with a rotary cone bit such as illustrated in FIG. 2.

Said figures also show the circle C2 of diameter D2 which is tangential to the bases of studs 4. Diameter D2 is slightly more than the diameter of bore 2 and is equal to the diameter of the smallest stones. Also shown in said Figures is the circle C1 of diameter D1 which is tangential to the top parts of studs 4. Diameter D1 is equal to the diameter of the biggest stones.

Figure 5:
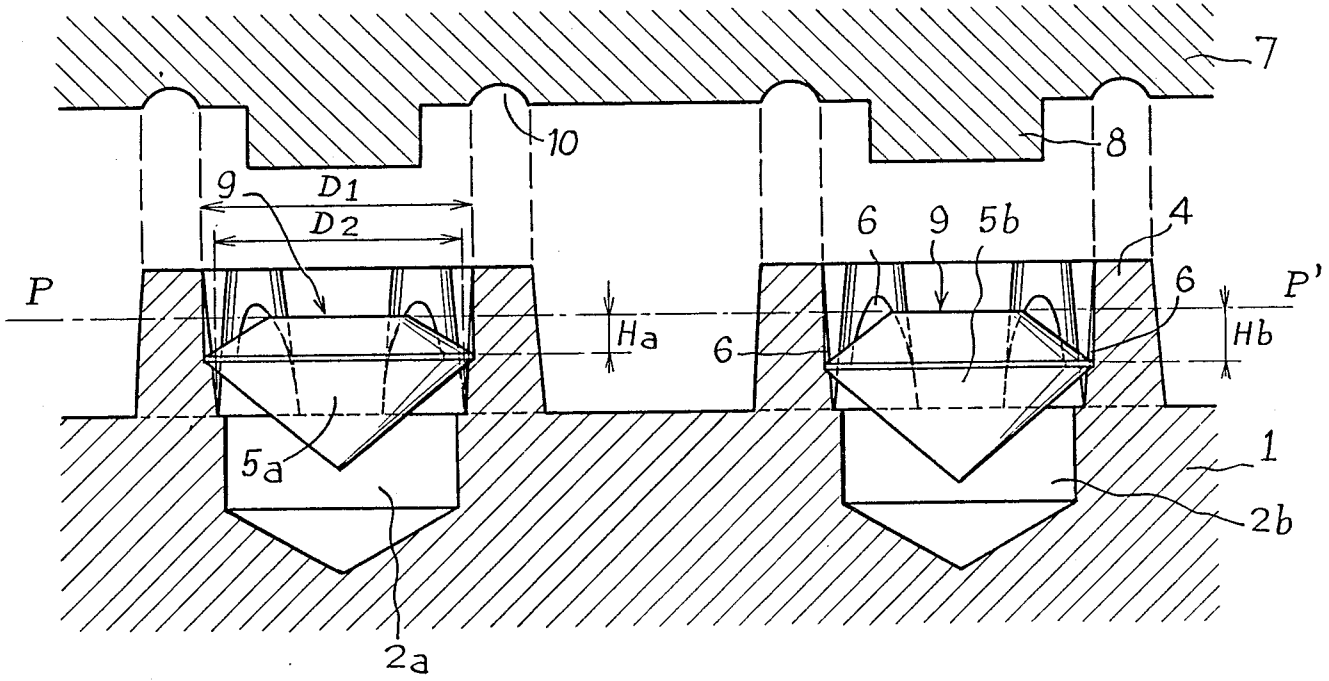

FIG. 5 illustrates two stones 5*a* and 5*b* which are each engaged in a housing, respectively 2*a* and 2*b*. Said FIG. 5 also shows the height Ha, Hb of the upper face 9 of each stone, that is the distance separating the external visible face 9 of the stone from the plane passing through the largest external outline of the stone which determines the diameter of said stone.

The two stones illustrated in FIG. 5 are of completely different height: stone 5*a* having for example a height Ha equal to 0.16 mm and stone 5*b* a height equal to 0.22 mm.

When the bores 2*a*, 2*b* and the truncated studs 4 around them have been machined, a stone 5 is inserted in each housing, all the stones used being of same size grading ranging between two mesh diameters D1 and D2, namely stones of diameter smaller than D1 and greater than D2.

All the stones are freely insertable inside the studs since the diameter D1 of the circle inscribed inside the top parts of the studs is equal to the maximum limit D1 of the selected size grading and the stones come to rest against six generatrices of the lateral conical walls of the studs 4 since the diameter D2 of the circle inscribed in the studs bases is equal to the minimum limit of the selected size grading.

The upper faces 9 of the stones are then situated at different levels because, first, of the important differences in the height H of the stones and, and second, of the slight differences in the external diameter of the stones, in the same size grading.

A push member 7 is then applied on the upper faces 9 of the stones, said push member being provided with projections 8 of similar height which penetrate freely between the studs 4 and which press against the upper faces 9 of the stones. At the beginning of the operation, only a few of the projections press against the stones with the highest upper faces. When pressure is applied to the push member, the highest stones exert a pressure against the generatrices of the six studs 4 on which they are resting and said pressure is sufficient to deform permanently the metal by pushing a thin strip of metal 6 downwardly, said strip becoming wider and deeper as the stone goes down. As the push member goes down, it comes against the upper faces of the other stones. When said push member has travelled down over a height equal to the maximum height difference between the various stones, i.e. about 10% of the diameter of the stones, the push member is then in contact with the upper faces 9 of all the stones, and said stones are uniformly placed inside the same plane PP'.

FIG. 5 illustrates one embodiment in which the support 1 has a flat external face and the lower faces of the projections 8 are situated in the same plane, parallel to said external face.

In the case where the support 1 has a curved external face, the lower faces of said projections 8 are situated on a surface parallel to said external face and, at the end of the operation, the upper faces 9 of all the stones are situated on the same surface parallel to the external face of support 1.

Once the stones 2*a*, 2*b* are sunk into their housing, they are set therein by deforming the studs, with a setting tool applied against the heads of the claws. Advantageously, the setting operation is carried out mechanically.

In the embodiment illustrated in FIG. 5, the push member 7 comprises, on its lower face, small cavities 10 which fit over the top of each stud in order to cause buckling thereof.

FIGS. 6 and 7 illustrate a first step during which equidistant bores are machined in a metal support 1, said bores being cut in staggered arrangement, or in a row, or according to a checquered pattern. Each bore 11 is extended by a blind reverse bore 12 of smaller diameter. All of said bores are produced simultaneously with a drill mounted on a numerical control machine.

FIGS. 8 and 9 illustrate another step in the process, during which truncated shape studs 4 are machined in the support 1, with a rotary cone bit which removes ring of metal.

As in the preceding example, the cutting edges of the cone bit are slightly inclined with respect to the axis thereof, so that the side walls of the studs 4 diverge downwardly with a conicity angle of about 6°.

The studs 4 are situated at the apices of a polygon which surrounds each bore 11 and at equal distance from the center of the bore.

FIG. 8 illustrates one example in which each stone is gripped by six claws situated at the apices of a hexagon.

FIGS. 8 and 9 illustrate one example in which the studs 4 are machined before the bores 11 and 12 are drilled. These two operations can in fact be performed in any order. For the sake of clarity, FIG. 8 shows in dotted lines the positions of the bores 11 and 12 in the centers of the studs 4. It is clear from the figure that the centers of the studs 4 are situated at a distance from the center of the bore 11 which is less than the sum of the radii of said bore and of the base of said studs.

The diameter of the bore 11 is greater than the diameter of the circle inscribed inside the bases of the studs 4 and smaller than the diameter of the circle inscribed inside the top parts of the studs 4.

FIGS. 10 and 11 illustrate respectively a plan view and a cross-section of a bore 12 surrounded by six studs 4. The height of the studs 4 is slightly more than the depth of the bore 11. According to said figures, each stud 4 comprises, on the lower part of its side faces, three cylindrical notches 11 the generatrices of which are vertical, resulting from the fact that the bore 11 overlaps the side walls of the studs 4 and that in consequence, said bore cuts into them. The three cylindrical notches 11 of each stud form a curved triangle and they are topped by a truncated portion.

The diameter of the bore 11 is smaller than the diameter of the smallest stones, for example, it is equal to 1.05 mm±0.02 for stones varying between 1.10 and 1.15 mm.

The diameter of the circle inscribed inside the top parts of the studs 4 is equal to or slightly greater than the diameter of the largest stones.

FIG. 12, like FIG. 5, illustrates a cross-section through two housings in the same support, in which housings are inserted two stones of similar size grading but having their upper face at different heights Ha and Hb.

According to said figures, the periphery of the stones cuts into the studs 4 by pushing back the metal. The cutting-in depth differs from one stone to the other and, at the end of the operation, the upper faces 16 of all the stones are uniformly in the same plane PP'.

The cylindrical notches 11 which are cut in the side walls of the studs 4 have the effect of eliminating the conicity of the walls from the top of the notches, hence avoiding that the thickness of the metal to be pushed back increases too much as the stones sink down.

The hachured areas 17 on the righthand side of FIG. 12 represent the metal pushed back by the stone 15*b*.

Once the stones 15*a*, 15*b* are sunk into their housings, the studs 4 are buckled up in order to be permanently deformed, with a setting tool which is pressed against the heads of the studs 4, which latter then become setting claws.

FIG. 13 is a perspective view of a stud 4 showing three cylindrical notches disposed at 120°, which are cut in the side wall by the bore 11, the diameter of which is greater than that of the circle inscribed inside the bases of the studs 4 situated around said bore 11.

What is claimed is:

1. A process for the mechanized production of jewelry comprising a plurality of small contiguous stones of similar size grading but different height, which stones are set in a metal support, process of the type consisting in machining in said support, contiguous and equidistant bores each one of which comprises a deformable seating on which rests a stone, and setting claws situated on the periphery of each housing and common to several stones, wherein said process further comprises:

machining on the periphery of each bore a plurality of truncated studs situated at the apices of a polygon surrounding said bore, the walls of which studs converge towards the external face of the support, using a conical tool to remove rings of metal which intersect one another;

placing in each bore one of said stones which rests on the side faces of said studs;

placing a push member over the upper faces of the highest stones, parallel to the external face of said support, and applying pressure thereon, thus pressing down the stones which push back the metal of said studs until said push member comes in contact with the upper faces of all the stones which are then all in the same plane or on the same surface parallel to the external face of said support; and finally setting in the stones by causing the deformation of the studs with a setting tool to form setting claws.

2. A process as claimed in claim 1, wherein the circle inscribed inside the top parts of the studs surrounding one bore, has a diameter equal to or greater than the diameter of the largest stones and the circle inscribed inside the bases of said studs has a diameter smaller than the diameter of the smallest stones.

3. A process as claimed in claim 2 for the production of jewelry comprising a plurality of stones of size grading determined by the diameters of the meshes of two superposed screens used for grading said stones, wherein the diameter of the circle inscribed inside the bases of the studs around one bore is equal to the diameter of the meshes of the screen on which the stones are stopped, and the diameter of the circle inscribed inside the top parts of said studs is equal to the diameter of the meshes of the screen immediately above.

4. A process as claimed in claim 1, wherein a plurality of bores is machined in said support which bores are extended by blind reversed bores, each bore having a diameter greater than that of the circle inscribed in the bases of the studs around it, so that each stud comprises cylindrical notches which are cut into its side walls by said bores.

5. A process as claimed in claim 4, wherein the diameter of said bores is smaller than the diameter of the smallest stones.

* * * * *